US006572242B2

(12) United States Patent
Marquardt et al.

(10) Patent No.: US 6,572,242 B2
(45) Date of Patent: Jun. 3, 2003

(54) ILLUMINATOR FOR A SIGNAL LAMP

(75) Inventors: Erich Marquardt, Rietheim-Weilheim (DE); Siegfried Neumann, Wehingen (DE); Juergen Marquardt, Rietheim-Weilheim (DE); Dirk Rothhaas, Donaueschingen (DE)

(73) Assignee: WERMA Signaltechnik GmbH & Co., Rietheim-Weilheim (DE)

( * ) Notice: Subject to any disclaimer, the term of this patent is extended or adjusted under 35 U.S.C. 154(b) by 0 days.

(21) Appl. No.: 09/832,801

(22) Filed: Apr. 12, 2001

(65) Prior Publication Data

US 2001/0040804 A1 Nov. 15, 2001

(30) Foreign Application Priority Data

Apr. 12, 2000 (DE) ..... 100 18 222
Aug. 3, 2000 (DE) ..... 100 38 561

(51) Int. Cl.[7] ..... F21V 3/00

(52) U.S. Cl. ..... 362/240; 362/244; 362/254; 362/545; 362/800; 362/802; 439/332; 439/335; 439/336; 439/611; 439/613; 439/616

(58) Field of Search ..... 362/240, 244, 362/545, 800, 812, 254; 439/336, 332, 335, 611, 613, 615, 616, 76.1, 733.1

(56) References Cited

U.S. PATENT DOCUMENTS

| | | | | | |
|---|---|---|---|---|---|
| 4,824,393 | A | * | 4/1989 | Armbruster | 439/332 |
| 5,160,200 | A | * | 11/1992 | Cheselske | 362/226 |
| 5,575,459 | A | * | 11/1996 | Anderson | 313/318.03 |
| 5,651,450 | A | * | 7/1997 | Priesemuth | 200/292 |
| 5,655,830 | A | * | 8/1997 | Ruskouski | 362/240 |
| 5,688,042 | A | * | 11/1997 | Madadi et al. | 362/240 |
| 5,726,535 | A | * | 3/1998 | Yan | 315/185 R |
| 6,252,350 | B1 | * | 6/2001 | Alvarez | 257/79 |
| 6,268,702 | B1 | * | 7/2001 | Fleck | 315/185 R |

FOREIGN PATENT DOCUMENTS

| | | | | |
|---|---|---|---|---|
| DE | 298 06 589 | | 10/1999 | |
| EP | 70014 A1 | * | 1/1983 | H01R/33/06 |

* cited by examiner

*Primary Examiner*—Sandra O'Shea
*Assistant Examiner*—James W Cranson, Jr.
(74) *Attorney, Agent, or Firm*—Crowell & Moring LLP

(57) ABSTRACT

An illuminator, in particular for a signal lamp, having at least one LED which is mounted on an LED printed circuit board is provided which permits uncomplicated and flexible production. A base housing of the illuminator is produced from plastic. The base housing is penetrated by at least two contact elements.

22 Claims, 5 Drawing Sheets

ILLUMINATOR FOR A SIGNAL LAMP

BACKGROUND AND SUMMARY OF THE INVENTION

This application claims the priorities of German Application Nos. 100 18 222.4, filed Apr. 12, 2000 and 100 38 561.3, filed Aug. 3, 2000, the disclosures of which are expressly incorporated by reference herein.

The invention relates to an illuminator, in particular for a signal lamp such as for a motor vehicle.

Various illuminators which use light emitting diodes (LEDs) as a source of illumination have already become known. Such an illuminator is described, for example, in the German Utility Model DE 298 06 589. The illuminator, further described herein as a "luminous means" in accordance with the prior art has a T-shaped printed circuit board which extends with the narrower, lower part into the base of the luminaire, where the electric connections leading to the outside are undertaken. A plurality of light emitting diodes are mounted in the upper, wider part of the printed circuit board.

By contrast, it is the object of the invention to propose a luminous means which exhibits a lower outlay of production and can, in particular, be constructed in a cost effective manner in high volume numbers.

This object is achieved by an illuminator, in particular for a signal lamp, having at least one LED, which is mounted on an LED printed circuit board, and having a base. A base housing is produced from plastic, and the base housing is penetrated by at least two contact elements.

Advantageous designs and developments of the invention are possible by means of the features described herein.

Accordingly, a luminous means according to the invention is provided with a base housing made from plastic. In addition to the more cost-effective production in large piece numbers, a plastic housing offers the advantage of electric and thermal insulation.

In this case, contact is made with the printed circuit board by virtue of the fact that at least two contact elements are provided which penetrate the housing of the base. Despite the insulating property of the base housing, current can be applied to the luminous means with the aid of the contact elements.

The contact elements are preferably arranged such that they penetrate a bottom plate of the base housing. It is possible thereby to fashion a base which can be inserted into standard holders and closes the required contact at the conventional contact points upon being plugged into the appropriate holder. The contact elements can, for example, be constructed in this case as contact pins which not only produce the external contact, but simultaneously project into the interior of the base as far as the components with which contact is to be made.

In a preferred embodiment of the invention, the contact elements are simultaneously provided with cutting and/or latching elements which serve the purpose of fixation in the base. By way of example, the cutting elements can be constructed in the form of, for example, sawtooth external teeth on the contact pins which cut into the base material upon being pressed in and thus mesh at least partially with the base plate, thus fixing the contact elements after they are pressed in. Latching elements with the aid of which the contact elements are latched on the base would also be conceivable in another embodiment.

In a particular embodiment of the invention, a base plate which is essentially transverse to the LED printed circuit board is provided, being connected to contact elements of the base. Owing to this type of construction, the base can be of the same design up to the base plate in each case for luminous means of different sizes.

Depending on the shape desired, the LED printed circuit board need only be used in a fashion appropriately modified in terms of size and shape.

A base for a luminous means according to the invention can be mounted with particular ease especially when use is made of a printed circuit board, fitted with said electronic components, as a base plate in conjunction with pin-shaped contact elements. All that is required in this case to finish the base unit is for the contact pins to be plugged in from the underside and connected to the base plate, which is put on from the top side of the base.

The connection of the contact pins to the base plate can be implemented in different ways. Thus, a plug-in, compression and/or soldered connection can be provided at this point. Preference is to be given in this case to solderless connections for the purpose of simplifying the mounting of the base according to the invention. Particularly in the case of a plug-in connection, this results in an extremely simple mounting of the cap by plugging together the three named different components, that is to say the contact pins of the base housing and the base plate.

In a development of the invention, this base with the essentially transverse printed circuit board can simultaneously contain electronic components such that the base constitutes a complete sub-assembly for a modular design of the luminous means. The components can be accommodated in this case either on the base plate or else also, without difficulty, in the base housing, because of the insulating property of the base housing. It is possible with the aid of such electronic components for the base to be configured as a complete connecting module for a multiplicity of different luminaires.

Thus, for example, the circuits required for supplying low-voltage power can be integrated into the base. Other functions, for example flashing functions, color selections or the like can also be accommodated in the base design according to the invention. If appropriate, when use is made of complex controls it is also possible for one or more control lines to be led outside from the base for the purpose of making contact.

The electronic components in the base housing or on the base plate can, for example, also contain electric circuits which enhance the interference immunity of the luminous means. Thus, for example, electromagnetic pulses, so-called surge and burst pulses which, for example can be produced by a lightening stroke or by power interruptions in the network, can be absorbed and ameliorated with the aid of such an electric circuit. This yields a substantially longer service life for a luminaire with luminous means according to the invention.

Moreover, if required it is possible straight away also to construct a plurality of LED printed circuit boards, for example in a triangular arrangement, for improved all around illumination on a base having said transverse base plate.

A base according to the invention is fitted with an LED printed circuit board in order to finish the luminous means. This printed circuit board is put on essentially transverse to the base plate, and contact is made with it. Various types of connections come into consideration, in turn, for making contact, for example a plug-in, compression or soldered connection. Solderless connections offer the advantage here, in turn, of simplified mounting.

Particularly in the case of a plug-in connection, the further construction of the luminous means according to the invention requires only that the desired LED printed circuit board be selected from a corresponding assortment and plugged on.

In a particular embodiment, fastening elements for further components are additionally integrally formed into the base housing. This can be done without difficulty chiefly by producing the base housing from plastic, and simplifies the mounting, for example of the base plate or of a cover on the base housing. All conceivable designs, for example a bayonet lock or threaded stub etc. come into consideration as fastening element in this case.

In a particularly advantageous embodiment, the fastening elements, for example for fixing the base plate or a spherical cap, are constructed as a latching element, and so the appropriate component can be mounted in a particularly simple and, if appropriate, redetachable fashion.

When the base plate is pressed into such latching elements, for example in the case of a plug-in connection, it is possible at the same time for contact to be made and for the base plate to be fixed with reference to the base housing.

In a development of the invention, there is provided as a cover a transparent spherical cap which surrounds the LED printed circuit board or LED printed circuit boards and is connected to the base element. The closure with the base can be constructed variously to be detachable or nondetachable. Thus, for example, the spherical cap can be bonded or welded to the base. Depending on the intended use, detachable connections, for example a latching or bayonet lock can also be conceived straight away.

The spherical cap can have a smooth outer surface, but in a particular embodiment it is also provided with light-guiding elements, for example lens profiles. The emission characteristic of the luminous means can be influenced with the aid of such a spherical cap structure. Prismatic structures can also be provided in order to implement a desired emission characteristic.

In addition to the function regarding the emission characteristic of the luminous means, the spherical cap also fulfills a protective and insulating function. Thus, for example, the spherical cap protects the interior of the luminous means against soiling. Moreover, the spherical cap constitutes a shock-hazard protection, since it insulates both electrically and thermally.

This protective and insulation function can be further improved, if required, by a seal between the spherical cap and the base of the luminous means.

In a departure from the form of spherical cap specified above, in other designs the spherical cap can be smooth and/or grooved both outside and inside.

In a particular embodiment of the invention, guide and/or fixing elements are also provided for the LED printed circuit board. These can be provided, for example, in the base housing or also in the base plate. However, it is advantageous also to fit an appropriate fixing element in the spherical cap. Such a fixing element can be provided in the inside of the spherical cap on its top side, such that in combination with fastening on the base plate or the base there is a comparatively large guide length, and thus a stable fastening of the LED printed circuit board.

The contact pins which penetrate the base plate of the base can be constructed not only to be electrically conductive, but also to be thermally conductive, and thus to promote the dissipation of heat from the interior of the luminous means.

A complete luminaire can be produced in a particularly favorable way with the aid of a luminous means according to the invention in the embodiment with the spherical cap specified above. In this case, the production of a complete luminaire further requires only a holder for the insertion of the luminous means which has appropriate holding elements for fixing at the desired place of use for all desired types of mounting, for example for bottom mounting, angle mounting, central mounting etc. Such a holder can have, for example, an external thread for fastening in a machine housing, a stand or the like. Insertion of the luminous means into the corresponding holder, which can, for example, contain conventional cable clamps for an electric connection, therefore finishes off the complete luminaire without the need for a complicated luminaire housing for the insertion of a luminous means with an additional spherical cap.

In a particular embodiment, it is expedient to provide for such a complete luminaire a seal between the holder and the base of the luminous means, such that the electric contact points between the holder and the luminous means are protected against the intrusion of dust and/or water.

Other objects, advantages and novel features of the present invention will become apparent from the following detailed description of the invention when considered in conjunction with the accompanying drawings.

DETAILED DESCRIPTION OF THE DRAWINGS

Figure 1:
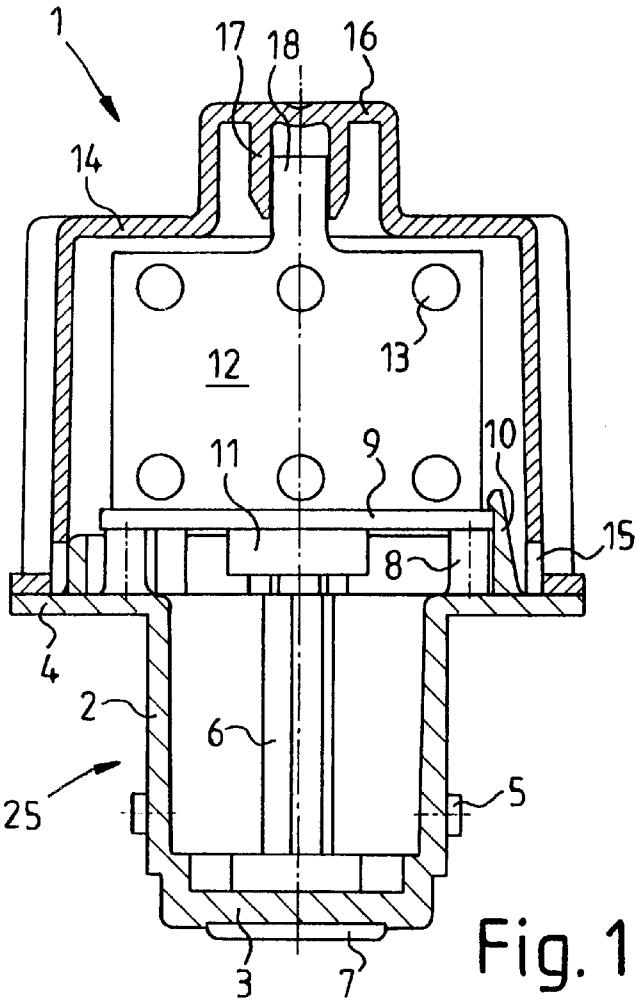
FIG. 1 shows a cross section through a luminous means according to the invention.

The luminous means 1 in accordance with FIG. 1 comprises a base housing 2 with a bottom plate 3 and an overhang 4. Two bayonet bosses 5 are fitted on the base housing 2 and can be used for inserting the base into conventional bayonet holders and fixing them.

Contact pins 6 which are described in more detail further below penetrate the bottom plate 3 of the base housing 2 and bear flat on the bottom side with a contact plate 7 against the bottom plate 3 of the base housing 2.

Integrally formed into the overhang 4 of the base housing 2 are spacers 8 which, in a way not illustrated in more detail, penetrate a base plate 9 with the aid of a section which tapers upward.

The base plate 9 is connected to the base housing 2 via the spacers 8 and via latching hooks 10, the contact pins 6 being connected to a connecting element 11 of the base plate 9, for example with the aid of a plug-in contact.

An LED printed circuit board 12 is plugged onto the base plate 9 in a fashion perpendicular to the base plate 9. The LED printed circuit board bears a plurality of light-emitting diodes 13 together with the circuit (not illustrated in more detail) for supplying electricity. The LEDs can in this case be wired, for example, using SMD technology, or be constructed as so-called chip-on-board elements.

A transparent spherical cap 14 is mounted on the overhang 4 of the base housing 2. The spherical cap 14 is provided on its underside with latching openings 15 to which latching elements (not illustrated in more detail) of the base housing 2 can engage. On the top side, the spherical cap 14 is provided with an indentation 16 on the inside of which a guide 17 is fitted for holding an extension 18 in the LED printed circuit board 12. The LED printed circuit board 12 is thereby fixed in its position in the interior of the spherical cap 14.

Figure 2:
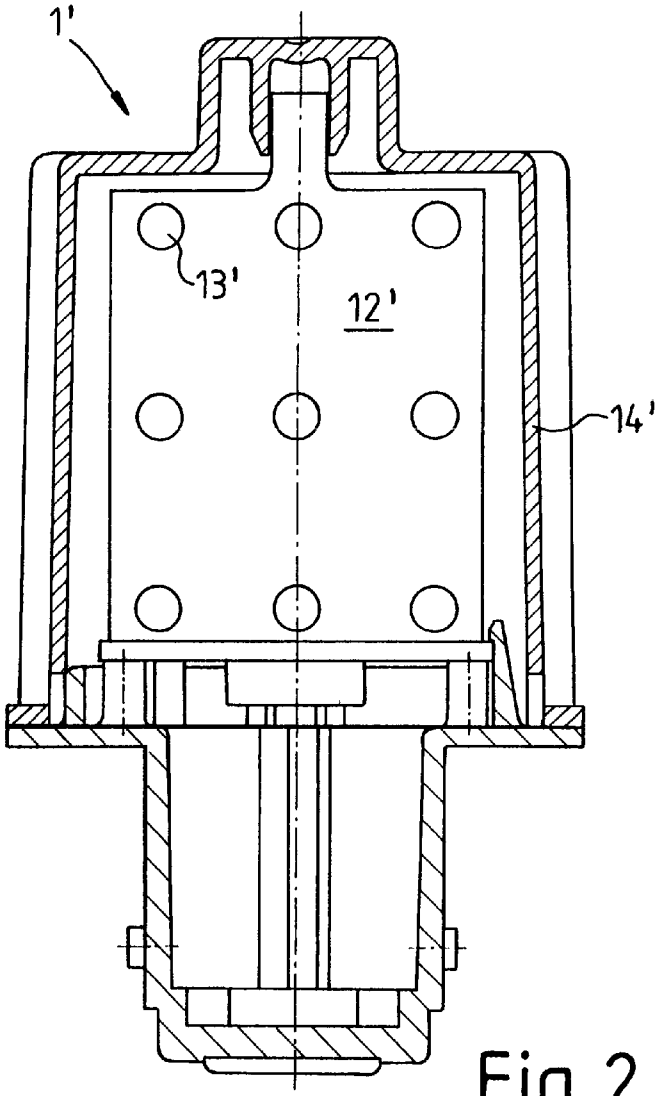
FIG. 2 shows an illustration of a luminous means in accordance with FIG. 1, with a larger LED printed circuit board.

The embodiment in accordance with FIG. 2 is substantially identical to that in accordance with FIG. 1, use now being made of a larger LED printed circuit board 12', which comprises a further row of light emitting diodes 13' and a correspondingly higher spherical cap 14 by comparison with the previously mentioned exemplary embodiment.

Figure 3:
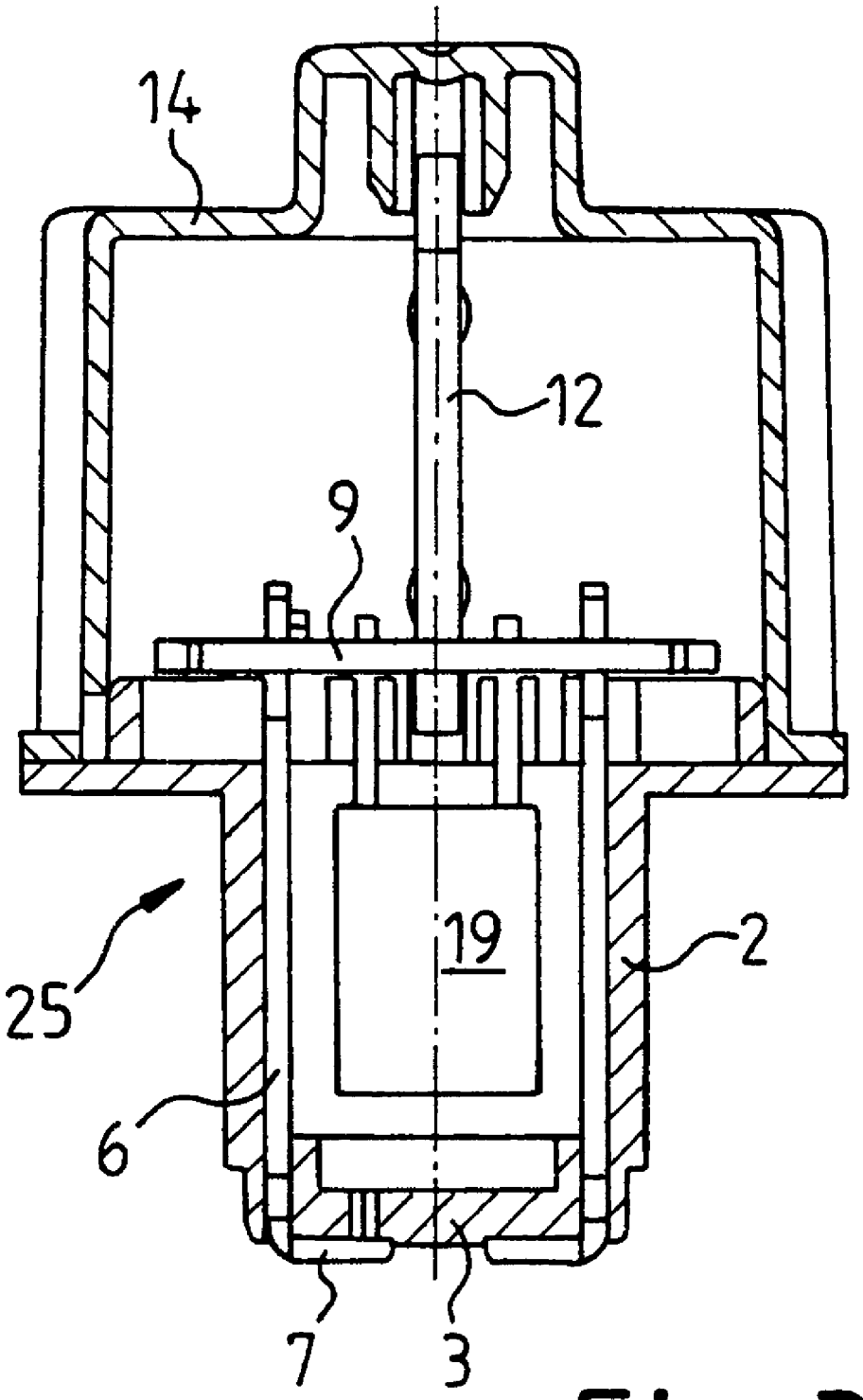
FIG. 3 shows an illustration, corresponding to FIGS. 1 and 2, of a further embodiment of the invention.

FIG. 3 corresponds substantially to the embodiments in accordance with FIGS. 1 and 2. In a departure therefrom, an electronic component 19 is accommodated in the base region of the base housing 25. Because of the use of plastic to form the base housing 25, there is no problem in doing this without further safety measures on the basis of the insulating properties.

Also to be seen in FIG. 3 is the course of the contact pins 6 with the contact plate 7 from outside the bottom plate 3 along the base housing 2 in the interior of the base 25.

Figure 4:
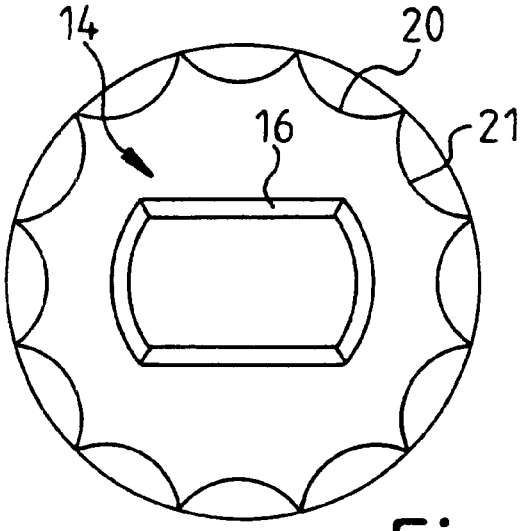
FIG. 4 shows a plan view of the spherical cap of a luminous means in accordance with FIG. 1 or 2.

The spherical cap 14 is illustrated in plan view in FIG. 4. The outer profile 20 is illustrated as a circumferential juxtaposition of concave cylindrical lenses 21. An inner profile of the spherical cap, for example with a corresponding lens function, would also be just as conceivable as the use of prismatic structures to implement the desired scattering characteristic. As may be seen, chiefly, in FIG. 3, the indentation 16 is not of circular design but designed with an elongated outer contour such that the indentation 16 serves not only to hold the guide 17, but at the same time as a handle for the overall luminaire 1 during insertion into a holder and upon rotation to close the bayonet lock.

Figure 5:
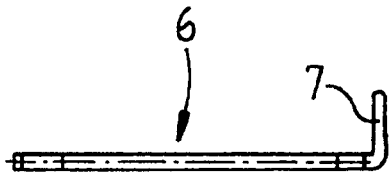
FIG. 5 shows a side view of a contact pin of a luminous means according to the invention.
Figure 6:
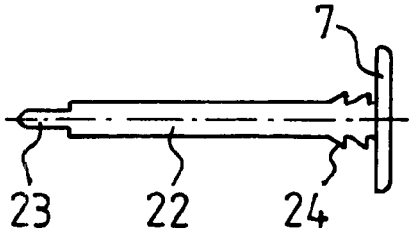
FIG. 6 shows a plan view of a contact pin in accordance with FIG. 5.

A contact pin 6 is illustrated before mounting in FIGS. 5 to 7. It consists substantially of a flat material which can be punched, for example. The contact pin 6 has a longitudinal part 22 for bridging the spacing between the contact plate 7 and the connecting element 11. The contact plate 7 is formed by a fold. A tapering plug tip 23 serves for plugging into the connecting element 11 of the base plate 9 (compare FIG. 1). Sawteeth 24 are fitted in the region of the contact plate 7 in the longitudinal part 22 of the contact pin 6, in order to fix the contact pin 6 in the pressed-in state in the bottom plate 3 of the base housing 2.

Figure 7:
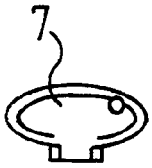
FIG. 7 shows an end view of a contact pin in accordance with FIGS. 5 and 6.

The oval shape of the contact plate 7 may be seen from FIG. 7. It is shaped such that the form of the contact corresponds to that of conventional lamp or luminous means, and so it is possible to use commercially available luminaire holders for the luminous means according to the invention.

In the described embodiment, the base housing 2 can be constructed directly as a plastic part, it being possible to spray on all additional elements, for example the spacers 8 or the latching hooks 10.

For mounting purposes, the contact pins 6 are subsequently pressed in through the bottom plate, where they are fixed with the aid of the sawteeth 24 cutting into the base material. The base plate 9 can now be mounted on the spacers 8 and latched with the aid of the latching hooks 10. The base 25 is mounted in this way as a finished module and is available for constructing different designs of luminous means 1, 1', for example with LED printed circuit boards 12, 12' of different size with the correspondingly associated spherical caps 14, 14'.

In addition to the connecting element 11, as already mentioned above, the base plate 9 can be provided with a multiplicity of various electronic components, for example for the purpose of supplying power to the LED 13, or of making safe against high voltage pulses, or else with a controller for controlling various functions, for example a flashing function, a color control, etc. Such components can be accommodated not only on the base plate 9, but also in the entire base region below the base plate 9.

The inventive design of the luminous means 1 results in a simple, cost effective and extremely flexible production for different luminous means 1, 1' with the use of the same preassembled base 25, which comprises at least the base housing 2, the contact pins 6 and the base plate 9.

Figure 8:
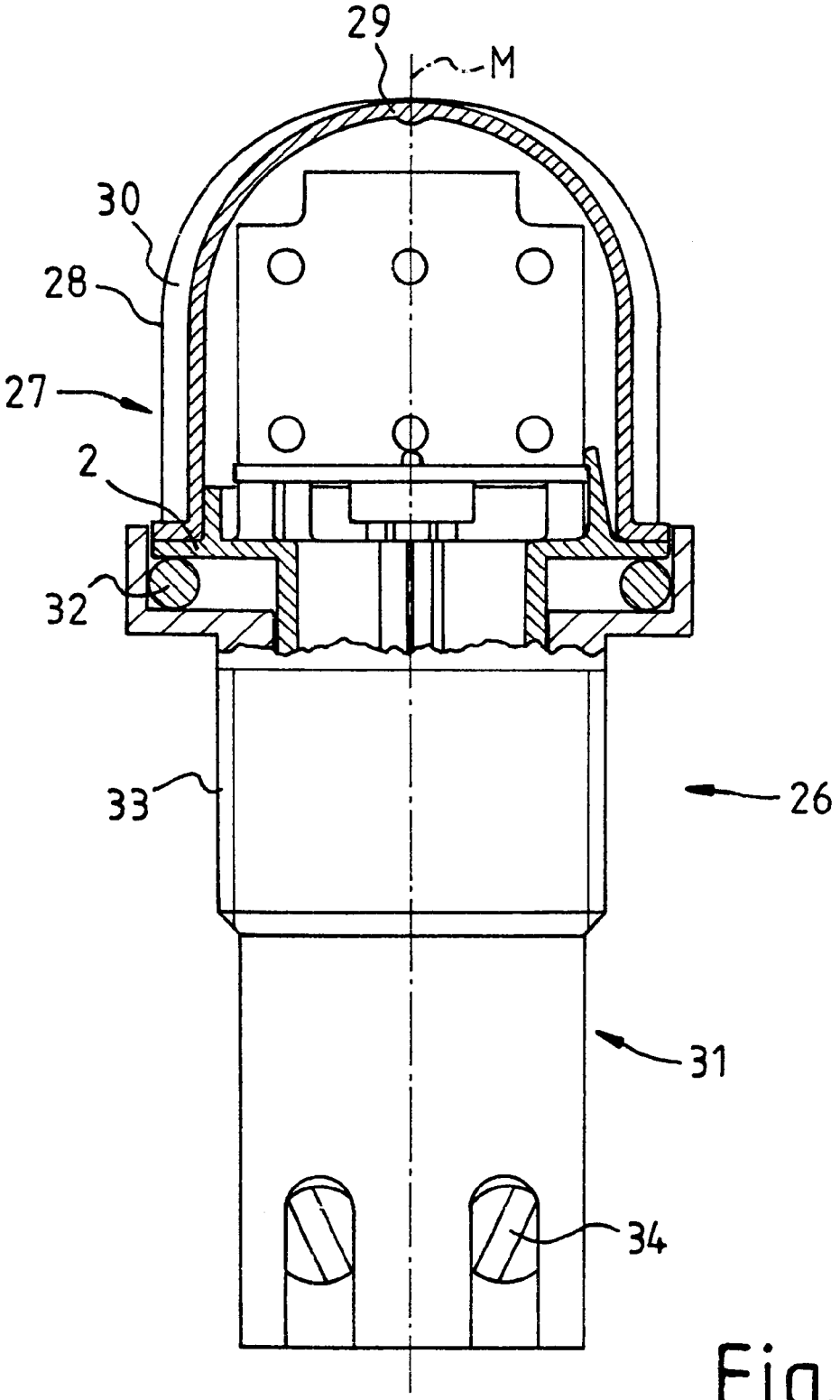
FIG. 8 shows a partial section through a complete luminaire with a luminous means according to the invention.

Furthermore, a complete luminaire can be produced in a particularly simple way with the aid of a luminous means according to the invention. Such a complete luminaire 26 is illustrated in FIG. 8. The luminous means 27 corresponds substantially to the previously described embodiments 1, 1', the spherical cap 28 having, in a fashion differing therefrom, a domed top side 29 without the indentation 16 with the inner guide 17. In accordance therewith, the concave lenses 30 are likewise curved toward the top side 29 and flattened in the course of the curve as far as the central axis M of the luminous means 27.

The luminous means 27 is plugged into a holder 31 and fixed there, for example with the aid of a bayonet lock described above. A sealing ring 32 in this case ensures a tight closure between the base housing 2 and the holder 31. The holder 31 is provided with a screw thread 33 for fastening at the desired place of use. A complete luminaire therefore results from plugging the luminous means 27 into the holder 31.

The holder 31 is provided in this embodiment with conventional cable clamps 34 for the electric connection of the complete luminaire 27.

In order to mount the complete luminaire, the holder 31 is fastened with the aid of the external thread at the desired place of use, for example on a machine housing, in a switchboard etc., it being possible for a sealing ring to be underlaid if required for the purpose of sealing the holder. The electric connection with the cable clamps 34 then takes place in the usual way in the interior of the holder. The complete luminaire 26 is finished by mounting the luminous means 27. In addition to the particularly simple way in which a separate luminaire housing is saved, this complete luminaire 26 with the luminous means 27 according to the invention has the further advantage of the particularly simple exchange of the luminous means, for example in the case of a defect or in the case of a change in function, for example for changing the color or other functions of the luminous means.

Figure 9:
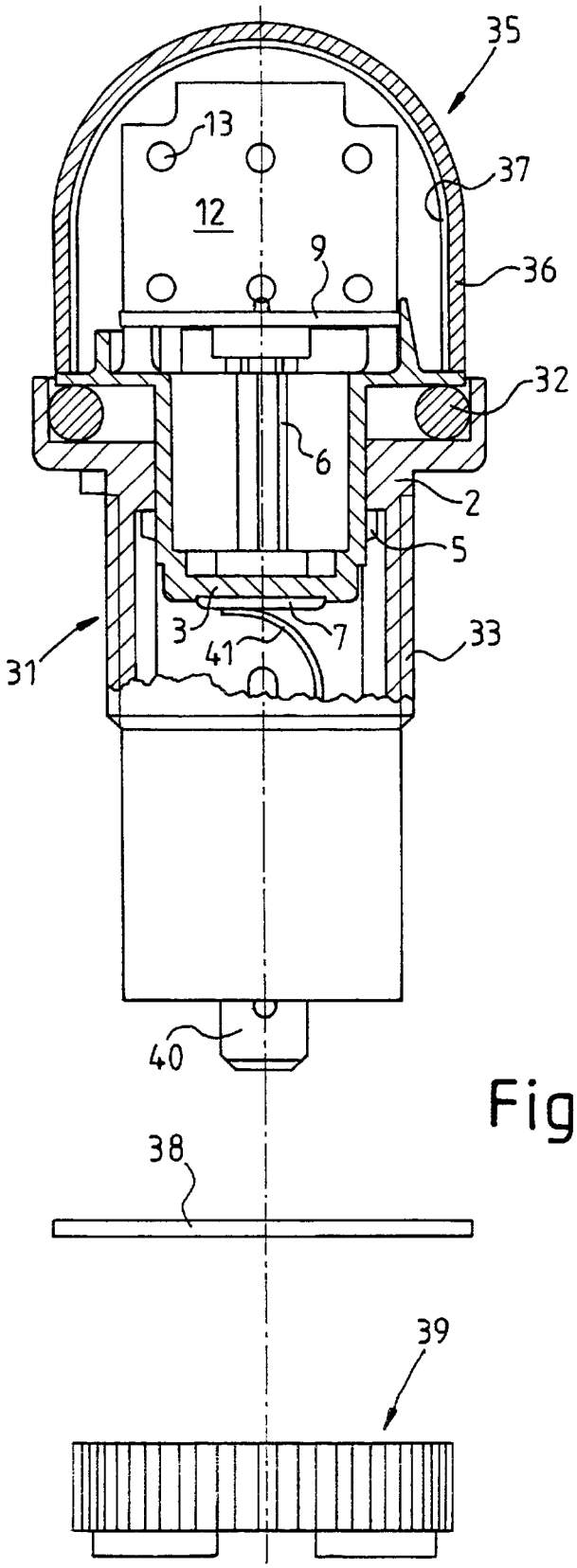
FIG. 9 shows a partial section through a further exemplary embodiment of a complete luminaire.

A further embodiment of a complete luminaire is illustrated in FIG. 9. The complete luminaire corresponds to the above-mentioned exemplary embodiments as regards the following details (not examined further).

By contrast with the complete luminaire in accordance with FIG. 8, the luminous means 35 is now provided with an externally smooth spherical cap 36. Fitted on the inside of the smooth and domed spherical cap 36 are scattering elements 37 which serve the purpose of influencing the emission characteristic of the luminous means 35 in the desired way.

The luminous means 35 is plugged into the holder 31 and locked there by means of the bayonet boss 5. In this process, an electric contact is closed via the contact plate 7 to the corresponding contact element 41 of the holder 31.

As in the previously mentioned exemplary embodiment, the holder 31 is provided with an external thread 33 for mounting at the desired place of use. Provided for this purpose in this case is a sealing washer 38 and a union nut 39 with the aid of which the complete luminaire can be screwed into a housing bore, for example.

Furthermore, by contrast with the previously mentioned exemplary embodiment in this case the contact with the holder 31 is provided via a tab connector 40 onto which conventional connector sleeves can be pushed as contact elements.

| Table of reference numerals: |
|---|
| 1 Luminous means (illuminator) |
| 2 Base housing |
| 3 Bottom plate |
| 4 Overhang |
| 5 Bayonet boss |
| 6 Contact pin |
| 7 Contact plate |
| 8 Spacer |
| 9 Base plate |
| 10 Latching hook |
| 11 Connecting element |
| 12 LED printed circuit board |
| 13 Light-emitting diode |
| 14 Spherical cap |
| 15 Latching opening |
| 16 Indentation |
| 17 Guide |
| 18 Extension |
| 19 Electronic component |
| 20 Outer profile |
| 21 Cylindrical lens |
| 22 Longitudinal part |
| 23 Plug tip |
| 24 Sawteeth |
| 25 Base |
| 26 Complete luminaire |
| 27 Luminous means |
| 28 Spherical cap |
| 29 Top side |
| 30 Concave lenses |
| 31 Holder |
| 32 Sealing ring |
| 33 Screw thread |
| 34 Cable clamps |
| 35 Luminous means |
| 36 Spherical cap |
| 37 Scattering element |
| 38 Sealing washer |
| 39 Nut |
| 40 Tab connector |
| 41 Contact element |

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An illuminator, comprising:

an LED printed circuit board;

at least one LED mounted on an LED printed circuit board;

a base on which the LED printed circuit board is mounted;

wherein a base housing of said base is plastic and has a bottom plate, and wherein at least two contact elements extend from the printed circuit board through the base housing; and further wherein each contact element forms a contact plate, via a fold in the contact element, which contact plate attaches to an exterior of the bottom plate of the base housing.

2. The illuminator according to claim 1, wherein the contact elements penetrate the bottom plate of the base housing.

3. The illuminator according to claim 1, further comprising at least one of cutting and latching elements that fix the contact elements in the base housing.

4. The illuminator according to claim 1, further comprising a base plate arranged transverse to the LED printed circuit board, the base plate being connected to the LED printed circuit board and to the contact elements.

5. The illuminator according to claim 4, further comprising at least one of a plug-in, soldered and compression connection for connecting the contact elements to the base plate.

6. The illuminator according to claim 1, further comprising electronic components arranged in the base.

7. The illuminator according to claim 4, further comprising electronic components arranged on the base plate.

8. The illuminator according to claim 1, wherein a plurality of LED printed circuit boards are provided.

9. The illuminator according to claim 4, wherein a solderless connection is provided between the base plate and the LED printed circuit board.

10. The illuminator according to claim 1, further comprising fastening elements for additional components, said fastening elements being integrally formed into the base housing.

11. The illuminator according to claim 10, wherein the fastening elements are constructed as latching elements.

12. The illuminator according to claim 1, further comprising a transparent spherical cap for the base housing.

13. The illuminator according to claim 12, wherein the spherical cap encompasses light-guiding elements.

14. The illuminator according to claim 12, wherein the spherical cap comprises a guiding element for the LED printed circuit board.

15. The illuminator according to claim 12, further comprising a seal arranged between the spherical cap and the base housing.

16. The illuminator according to claim 1, wherein said illuminator forms a signal lamp.

17. An illuminator assembly, comprising:

an illuminator, said illuminator including an LED printed circuit board, at least one LED mounted on an LED printed circuit board, a base on which the LED printed circuit board is mounted, and wherein a base housing of said base is plastic and has a bottom plate, and wherein at least two contact elements extend from the printed circuit board through the base housing, each contact element forming a contact plate, via a fold in the contact element, which contact plate attaches to an exterior of the bottom plate of the base housing, a holder adapted for mounting at a place of use, and wherein the holder holds the base of the illuminator.

18. The illuminator assembly according to claim 17, further comprising a seal arranged between the holder and the base of the illuminator.

19. The illuminator assembly according to claim 17, wherein the bottom plate of the base housing is penetrated by the contact elements.

20. The illuminator assembly according to claim 17, wherein the illuminator further comprises at least one of cutting and latching elements for fixing the contact elements in the base housing.

21. The illuminator according to claim 1, wherein the contact plate bears flat against the exterior side of the bottom plate of the base housing.

22. The illuminator according to claim 17, wherein the contact plate bears flat against the exterior side of the bottom plate of the base housing.

* * * * *